US012104383B2

(12) United States Patent
Crookston

(10) Patent No.: US 12,104,383 B2
(45) Date of Patent: Oct. 1, 2024

(54) FASTENING SUPPORT FOR HALF ROUND GUTTERS

(71) Applicant: Charles Augustine Crookston, Kalamazoo, MI (US)

(72) Inventor: Charles Augustine Crookston, Kalamazoo, MI (US)

( * ) Notice: Subject to any disclaimer, the term of this patent is extended or adjusted under 35 U.S.C. 154(b) by 0 days.

(21) Appl. No.: 18/598,780

(22) Filed: Mar. 7, 2024

(65) Prior Publication Data

US 2024/0209635 A1 Jun. 27, 2024

Related U.S. Application Data

(63) Continuation of application No. 18/543,681, filed on Dec. 18, 2023, now abandoned.

(51) Int. Cl.
*E04D 13/072* (2006.01)

(52) U.S. Cl.
CPC ..... *E04D 13/0725* (2013.01); *E04D 13/0727* (2013.01); *E04D 13/0722* (2013.01)

(58) Field of Classification Search
CPC ..... E04D 13/0725; E04D 13/0722; E04D 13/0727; E04D 13/072; E04D 13/076; E04D 13/064; E04D 13/068
USPC ..... 248/48.1, 48.2
See application file for complete search history.

(56) References Cited

U.S. PATENT DOCUMENTS 146,855 A * 1/1874 Abbott ..... E04D 13/0722 248/48.1
1,392,966 A 10/1921 Rachlin
1,855,241 A 4/1932 Irwin
2,536,704 A 1/1951 Sjea et al.
2,565,090 A 8/1951 Ramser
2,631,801 A * 3/1953 Toal ..... E04D 13/0725 248/48.1

(Continued)

FOREIGN PATENT DOCUMENTS

FR 2216417 A1 8/1974
FR 2563263 A1 10/1985

(Continued)

OTHER PUBLICATIONS

Bespoke Guttering, "The Various Sytles of Gutter," 2023, pp. 1-3.

*Primary Examiner* — Taylor Morris

(74) *Attorney, Agent, or Firm* — Kintner IP, LLC; Mary Frances Ludwig

(57) ABSTRACT

Fastening support devices and systems for hanging half round gutter include engagement portions for internal engagement with the front and rear of a gutter. A rear face of the device may be configured to provide support to a curved rear gutter wall, such as the rear wall of a half round gutter. The rear face may include a substantially vertical upper portion adjacent a curved lower portion. A support body of the device may include a substantially planar lower surface, two or more internal supports projecting upwardly from the lower surface, and one or more thin walls interconnecting the internal supports and the lower surface. These features provide structural rigidity to the device and support the gutter to resist bending under heavy loads. Additional features of the device provide ease of installation and improved aesthetics of the overall gutter system.

15 Claims, 17 Drawing Sheets

(56) References Cited

U.S. PATENT DOCUMENTS 2,710,159 A * 6/1955 Gordon ..... E04D 13/0722 248/300
2,761,642 A * 9/1956 Pollock ..... E04D 13/0725 248/48.1
3,022,029 A 2/1959 Blayden
3,300,911 A * 1/1967 Riddell ..... E04D 13/064 52/16
3,333,803 A * 8/1967 Landis ..... E04D 13/072 52/95
3,436,878 A * 4/1969 Singer ..... E04D 13/076 52/95
4,169,570 A * 10/1979 Morin ..... E04D 13/0725 52/16
4,294,422 A * 10/1981 Odekirk ..... E04D 13/0725 248/48.2
4,632,342 A * 12/1986 Skinner ..... E04D 13/068 248/48.2
4,776,544 A 10/1988 Williams
5,067,675 A * 11/1991 Brant ..... E04D 13/0725 248/48.2
5,098,045 A 3/1992 Pepper
5,570,860 A * 11/1996 Schoenherr ..... E04D 13/0725 248/48.2
5,575,118 A * 11/1996 Vahldieck ..... E04D 13/076 52/12
5,845,435 A 12/1998 Knudson
6,254,039 B1 * 7/2001 Zimmerman ..... E04D 13/0725 248/48.1
6,453,622 B1 * 9/2002 Walters ..... E04D 13/076 52/12
6,543,729 B1 * 4/2003 Ylonen ..... E04D 13/0725 52/715
7,117,643 B2 * 10/2006 Brown ..... E04D 13/064 52/12
7,581,355 B2 * 9/2009 Smith ..... E04D 13/0727 52/12
7,584,576 B2 * 9/2009 McDonald ..... E04D 13/076 52/12
8,104,230 B2 * 1/2012 Gramling ..... E04D 13/076 52/12
8,117,785 B2 * 2/2012 Teichner ..... E04D 13/076 52/12
8,176,687 B2 * 5/2012 Roque Alonso .... E04D 13/0641 52/12
8,225,556 B2 * 7/2012 Brown ..... E04D 13/0725 52/12
8,510,999 B2 * 8/2013 Gramling ..... E04D 13/076 52/12
8,997,403 B1 * 4/2015 Steinberg ..... F16M 13/02 52/12
9,340,980 B2 * 5/2016 Walters ..... E04D 13/0727
9,624,673 B2 4/2017 Conner
10,267,043 B2 4/2019 Conner
2005/0082436 A1 4/2005 Snell
2006/0037254 A1 * 2/2006 Brochu ..... E04D 13/076 52/14
2006/0037255 A1 * 2/2006 Brochu ..... E04D 13/076 52/14
2009/0139152 A1 * 6/2009 Smith ..... E04D 13/0727 24/546
2014/0019640 A1 1/2014 Fitchett
2016/0168857 A1 * 6/2016 Neumann ..... E04D 13/064 52/16
2016/0333589 A1 11/2016 Zondlak

FOREIGN PATENT DOCUMENTS

GB 191225692 A 3/1913
GB 2145754 A 4/1985

* cited by examiner

FASTENING SUPPORT FOR HALF ROUND GUTTERS

CROSS REFERENCE TO RELATED APPLICATION

This application is a continuation of U.S. patent application Ser. No. 18/543,681, filed Dec. 18, 2023, which is hereby incorporated in its entirety.

TECHNICAL FIELD

The present disclosure pertains generally to devices, systems, and methods for hanging gutter systems with hanging means situated inside the gutter, and more particularly to fastening supports for half round gutters.

BACKGROUND OF THE INVENTION

Fastening supports for gutters exist, including hangers that are meant to be installed internal to the gutter. Such hangers are generally designed for use with gutters that have a vertical back that faces the structure where the gutter is hung (such as the common "K-style" gutter profile). When a load is placed on this type of gutter, such as from snow or ice, the gutter is prevented from bending downwardly by the back of the gutter which contacts the supporting structure. However, if such an internal hanger is used with a half round gutter profile, the curved back of the gutter is unsupported, and has a tendency to bend downward when under a loading condition.

There is therefore a need for an internal gutter fastener that is suitable for supporting half round gutter under loaded conditions.

BRIEF SUMMARY OF THE EMBODIMENTS

Embodiments disclosed herein are directed to fastening support devices and systems, particularly for hanging half round gutter. A fastening support device includes engagement portions configured for internal engagement with each of the front and the rear of a gutter. For example, a front gutter engagement portion may engage with an inwardly bending front edge (such as a reverse bead) of the gutter. A rear face of the device may be configured to provide support to a curved rear gutter wall, such as the rear wall of a half round gutter. To this end, the rear face may include a substantially vertical upper portion adjacent a curved lower portion. A support body of the device may include a substantially planar lower surface, two or more internal supports projecting upwardly from the lower surface, and one or more thin walls interconnecting the internal supports and the lower surface. These features provide structural rigidity to the device and support the gutter to resist bending under heavy loads. Additional features of the device provide ease of installation and improved aesthetics of the overall gutter system.

According to one or more embodiments, a fastening support device is structurally configured to cooperate and engage with a half round gutter having an inwardly bending front edge, a rear edge, and an internal gutter wall. The device further cooperates with a fastener. The device includes: a support body having a front end and a rear end opposing the front end; a front gutter engagement portion disposed at the front end and structurally configured for engagement with the inwardly bending front edge of the half round gutter; a rear gutter engagement portion disposed at the rear end and structurally configured for engagement with the rear edge of the half round gutter, the rear gutter engagement portion having a rear face configured to contact the internal gutter wall, the rear face having a substantially vertical upper portion adjacent a curved lower portion; and a fastener channel structurally configured to receive the fastener therethrough, the fastener channel open to the rear face and accessible from the front end when the front gutter engagement portion is engaged with the inwardly bending front edge; wherein the support body, the front gutter engagement portion, and the rear gutter engagement portion are unitarily formed.

According to one or more embodiments of the device, the front gutter engagement portion is shaped substantially complementary to the inwardly bending front edge of the half round gutter.

According to one or more embodiments of the device, the support body includes a substantially planar lower surface extending between the front gutter engagement portion and the rear gutter engagement portion.

According to one or more embodiments of the device, the support body includes two or more internal supports projecting upwardly from the lower surface.

According to one or more embodiments of the device, the two or more internal supports span an entire width of the support body.

According to one or more embodiments of the device, the two or more internal supports and the lower surface are connected by one or more thin walls.

According to one or more embodiments of the device, the fastener channel extends forwardly along the support body up to a forwardmost internal support of the two or more internal supports.

According to one or more embodiments of the device, the curved lower portion of the rear face extends below the lower surface.

According to one or more embodiments, the device furthering includes a gusset located in an angle formed between the rear gutter engagement portion and the lower surface.

According to one or more embodiments of the device, the gusset includes a rounded edge.

According to one or more embodiments of the device, the rear gutter engagement portion has an inwardly tapered upper edge.

According to one or more embodiments of the device, at least a portion of the fastener channel is open on a side of the support body.

According to one or more embodiments of the device, when the front gutter engagement portion is engaged with the inwardly bending front edge and the rear gutter engagement portion is engaged with the rear edge of the half round gutter, the support body is entirely located internal to the half round gutter.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the fastening support for half round gutters are described with reference to the following figures, wherein like reference numerals refer to like parts throughout the various views unless otherwise specified.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

The detailed description describes non-limiting exemplary embodiments. Any individual features may be combined with other features as required by different applications for at least the benefits described herein. As used herein, the term "about" means plus or minus 10% of a given value unless specifically indicated otherwise. As used herein, the terms "substantially" or "substantially the same" mean that two items are at least 90% the same; for example, a feature described as "substantially parallel" May be parallel to within 90%, an element described as "substantially circular" may be circular to within 90%, and so on.

As used herein, the conjunction "or" is to be construed inclusively (e.g., "A or B" would be interpreted as "A, or B, or both A and B"; e.g., "A, B, or C" would be interpreted as "A; or B; or C; or any two of A, B, and C; or all three of A, B, and C").

As used herein, disclosure of a singular element is also a disclosure of a plural element and vice versa unless otherwise noted.

In the present disclosure, many features are described as being optional, e.g. through the use of the verb "may" or the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features, or with all three of the three possible features.

Figure 1:
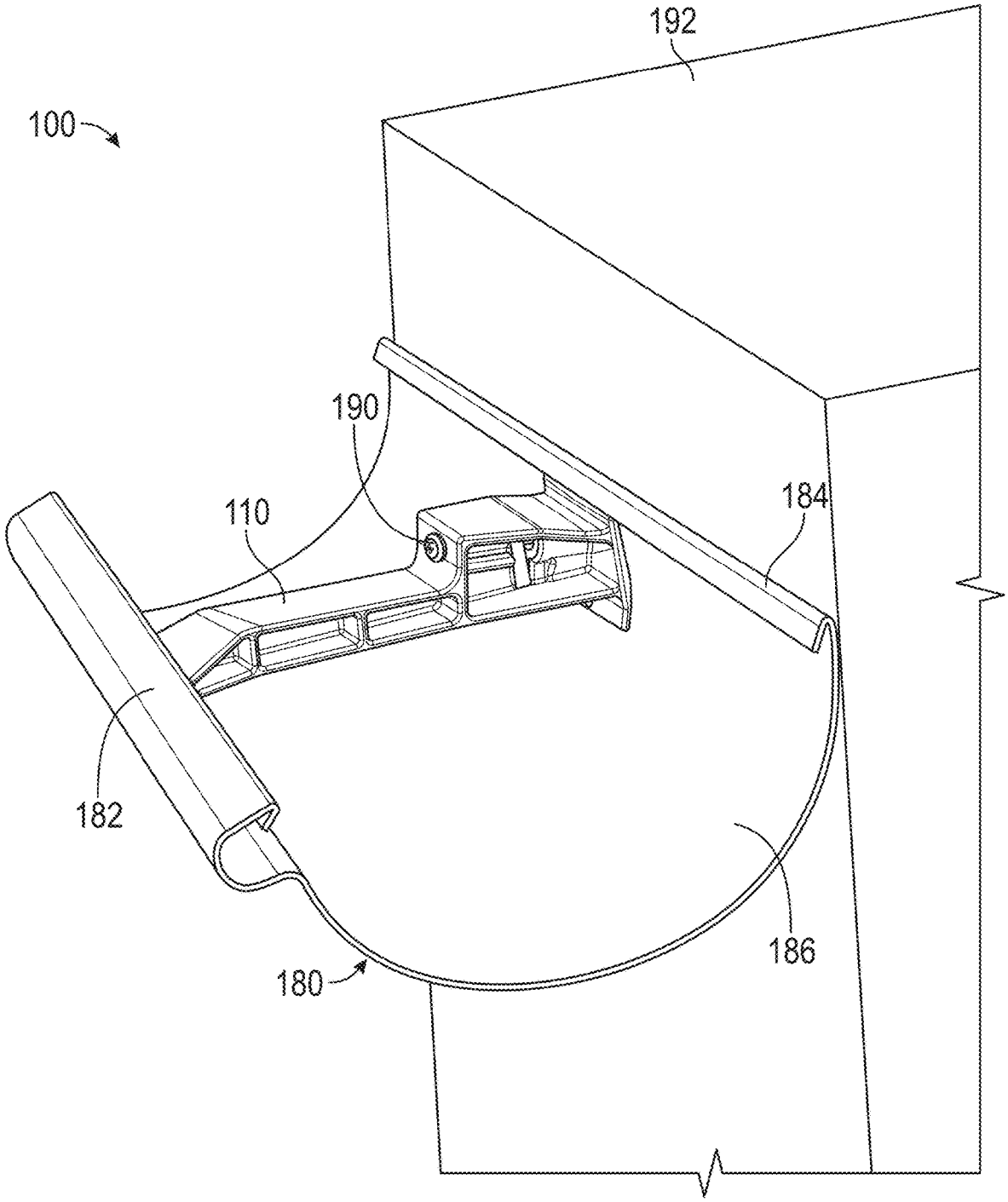
FIG. 1 is an example illustration of an embodiment of a fastening support system shown in use with a half round gutter.

FIG. 1 is an example illustration of an embodiment of a fastening support system 100 shown in use with a cooperating half round gutter 180. System 100 may include one or more fastening support devices 110 and one or more fasteners 190. Fastening support device 110 is shown inserted into gutter 180, and engaged with both an inwardly bending front edge 182 and a rear edge 184 of gutter 180. Inwardly bending front edge 182 may be, for example, a reverse bead of certain styles of half round gutter. In other cases, the gutter may have another style of inwardly bending front edge 182, or a portion of the gutter may be bent to engage with fastening support device 110. Similarly, rear edge 184 may be bent to engage with fastening support device 110 or fastening support device 110 may engage with a feature of the rear edge, depending on the profile of the gutter to be used. Fastener 190 is received within a fastener channel 118 of fastening support device 110, and used to fasten the gutter to a structure 192, such as the fascia of a building. When installed, fastening support device 110 provides support to an internal gutter wall 186 of gutter 180, and strengthens the gutter to resist bending under heavy loads, such as snow, ice, or the like.

FIGS. 2-5 are example illustrations of an embodiment of the fastening support, shown in first and second front perspective views, and first and second rear perspective views, respectively. The fastening support includes a support body 112 having a front end 114 and an opposing rear end 116. As used herein, the term "rear", or similar, refers to the direction of the structure to which the fastening support is to be mounted, while the term "front", or similar, refers to the direction away from said structure. The shown exemplary embodiment may be particularly well suited for use with a 6 inch half round gutter.

A front gutter engagement portion 124 is disposed at front end 114, and may extend along an entire width of front end 114, or may only extend along a portion of the width of front end 114. Front gutter engagement portion 124 is structurally configured to engage with inwardly bending front edge 182 of a half round gutter (e.g., gutter 180 of FIG. 1). Such engagement may be made by clipping, hooking, or similar, front gutter engagement portion 124 into inwardly bending front edge 182. To this end, front gutter engagement portion 124 may be shaped substantially complementary to an internal surface of inwardly bending front edge 182, or to another portion of internal gutter wall 186. For example, and as shown in the embodiment of FIGS. 2-5, front gutter engagement portion 124 may be shaped substantially complementary to a reverse bead of a half round gutter. In other embodiments, front gutter engagement portion 124 may be shaped differently, while still being securely engageable with inwardly bending front edge 182.

A rear gutter engagement portion 126 is disposed at rear end 116 (opposite front gutter engagement portion 124). Rear gutter engagement portion 126 is structurally configured for engagement with rear edge 184 of a half round gutter (e.g., gutter 180 of FIG. 1). Such engagement may be made by clipping, hooking, or similar, rear gutter engagement portion 126 into rear edge 184. Rear edge 184 may in some cases be a feature of a gutter profile. In other cases, a rear wall of the gutter may be bent around rear gutter engagement portion 126, thereby forming a bend in rear edge 184.

Rear gutter engagement portion 126 has a rear face 128 which is configured to contact the internal gutter wall (e.g., internal gutter wall 186 of FIG. 1). In some cases, substantially all of rear face 128 may be in contact with the internal gutter wall when the device is installed in a gutter. Rear face 128 is shaped to provide support to the gutter and resistance against bending under load (such as the weight of snow, etc.). To this end, rear face 128 may have an upper portion 130 which has a substantially vertical orientation when the device is fastened to a structure (see, e.g., upper portion 130 of the cross-sectional view of FIG. 12). Rear face 128 may also, or instead, have a lower portion 132 which is curved, such as with a curvature shaped substantially complementary to internal gutter wall 186 (see, e.g., FIG. 12). The shape of lower portion 132 provides additional resistance against the gutter bending under load. Upper portion 130 may be located immediately adjacent lower portion 132, or there may be a transitional portion therebetween. In embodiments, rear face 128 may be relatively wide compared to internal fasteners for K-style gutters; for example, rear face 128 may be about 2 inches, about 2.5 inches, about 3 inches, or between 1.5 inches and 3 inches wide.

Figure 6:
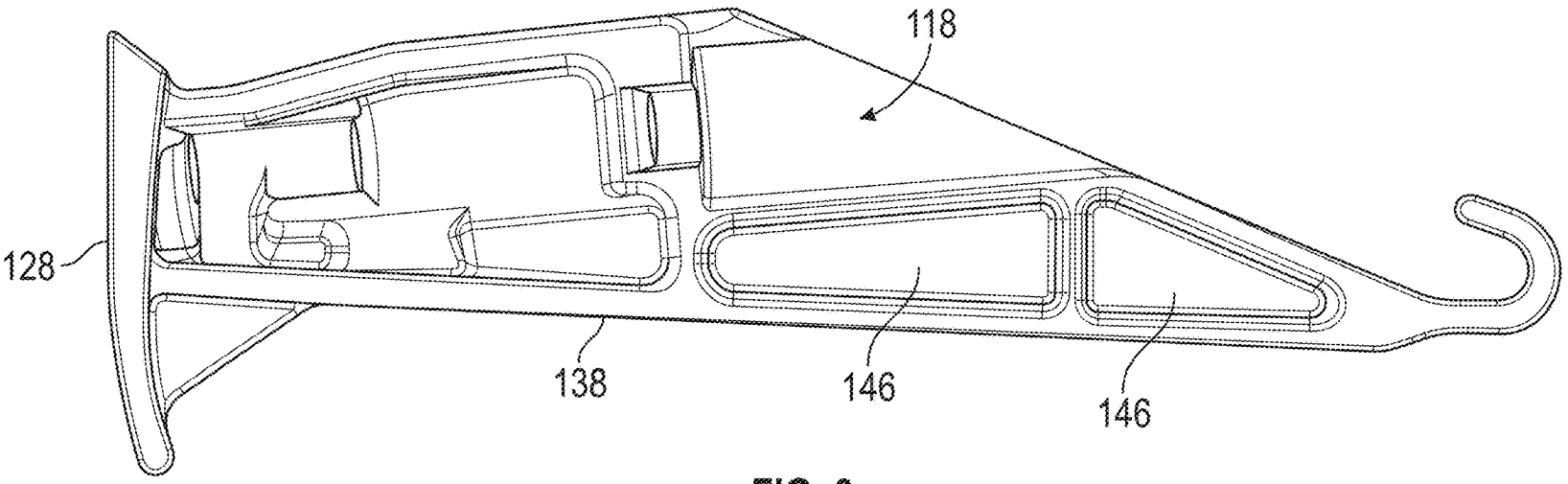
FIG. 6 is an example illustration of a first side elevation view of an embodiment of the fastening support.
Figure 7:
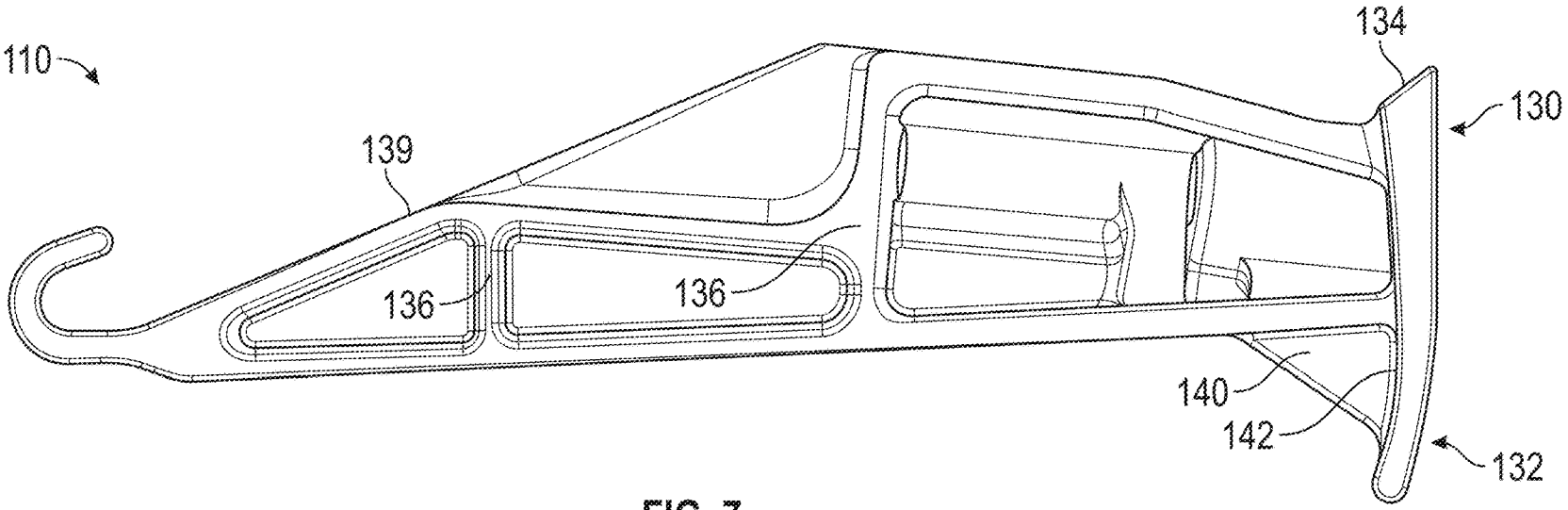
FIG. 7 is an example illustration of a second side elevation view of an embodiment of the fastening support.
Figure 8:
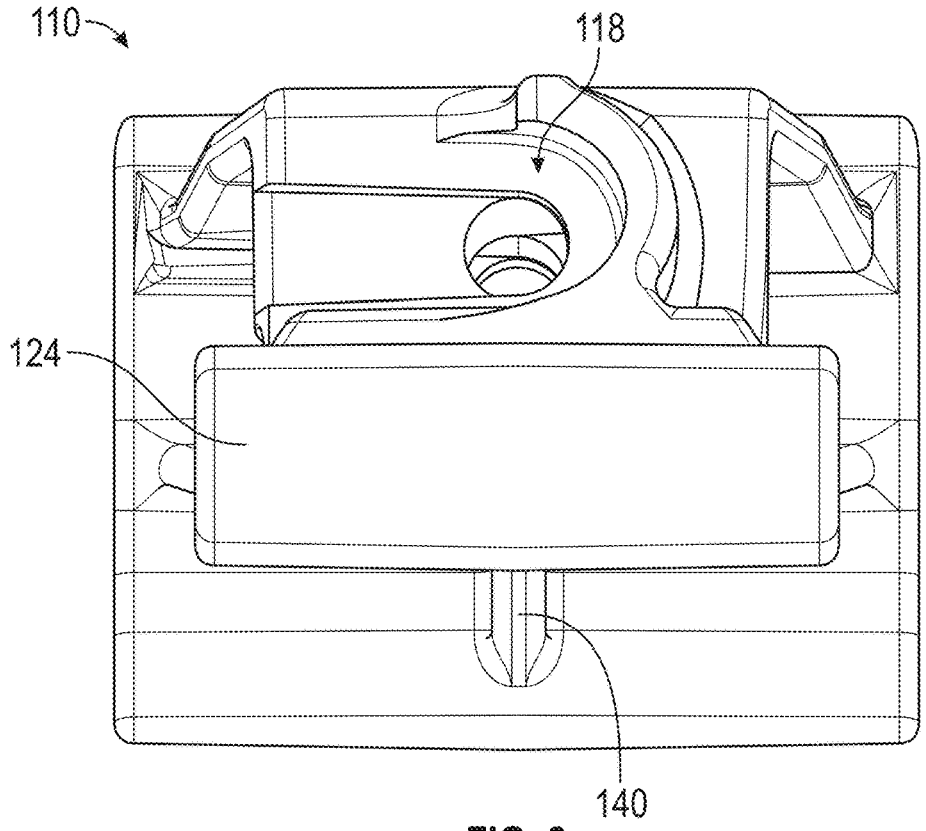
FIG. 8 is an example illustration of an enlarged front elevation view of an embodiment of the fastening support.
Figure 9:
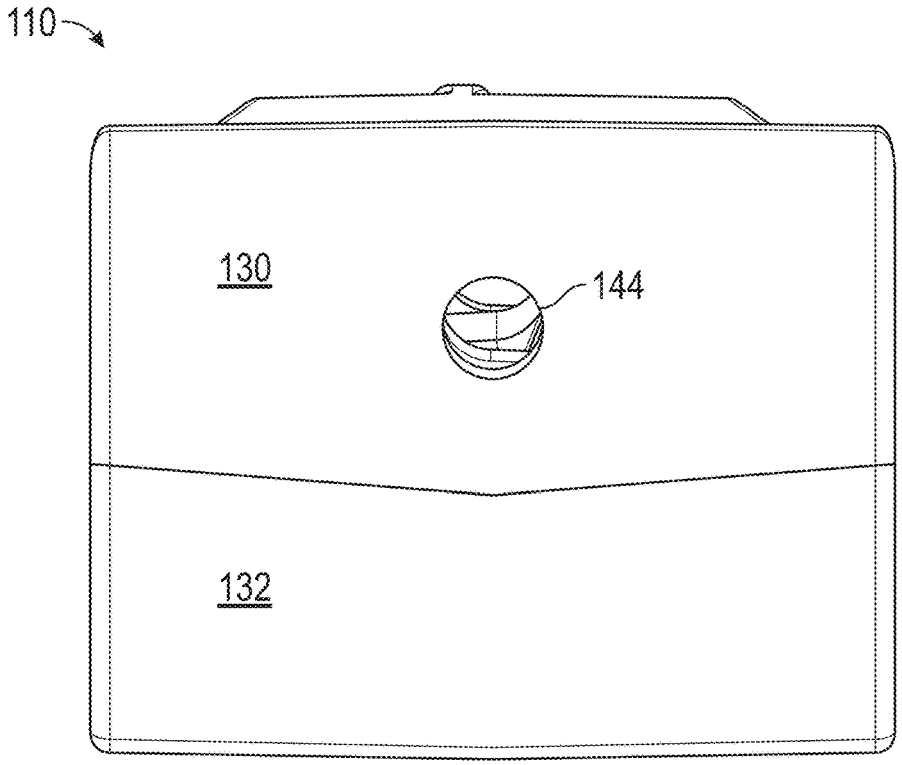
FIG. 9 is an example illustration of an enlarged rear elevation view of an embodiment of the fastening support.
Figure 10:
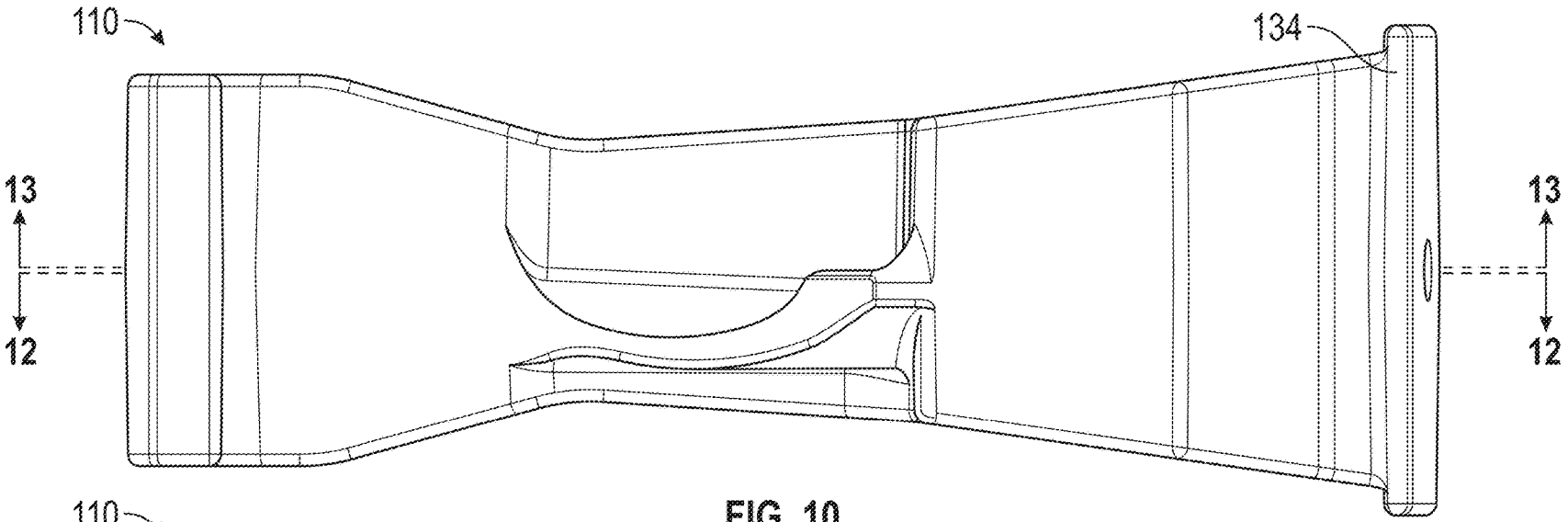
FIG. 10 is an example illustration of a top plan view of an embodiment of the fastening support.
Figure 11:
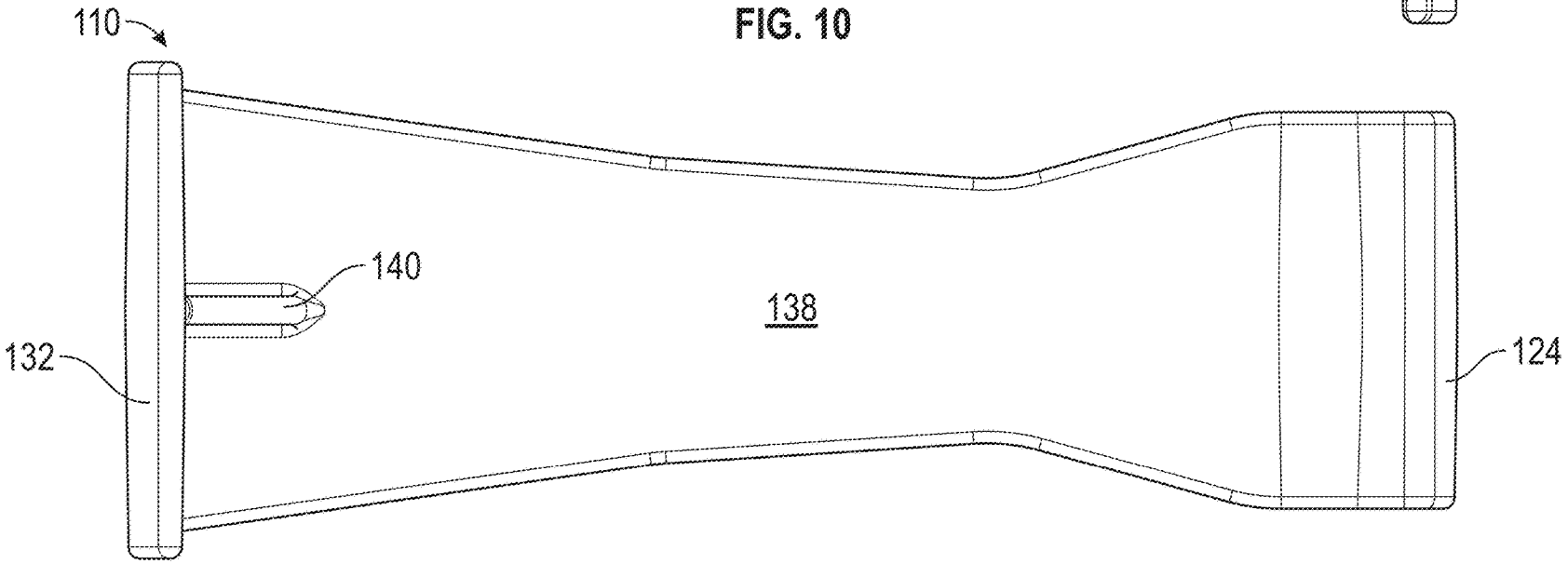
FIG. 11 is an example illustration of a bottom plan view of an embodiment of the fastening support.
Figure 12:
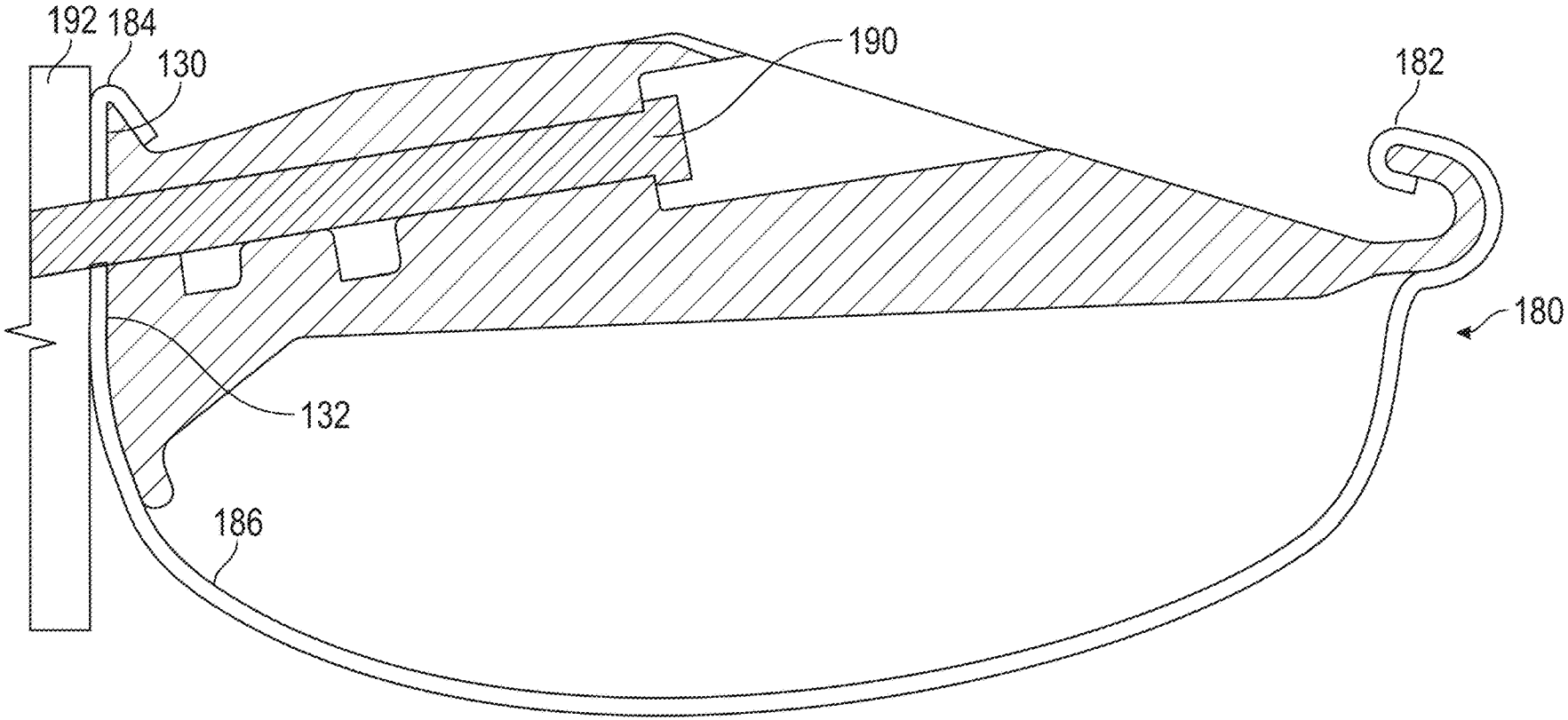
FIG. 12 is an example illustration of a cross-sectional view along the line 12-12 of FIG. 10.
Figure 13:
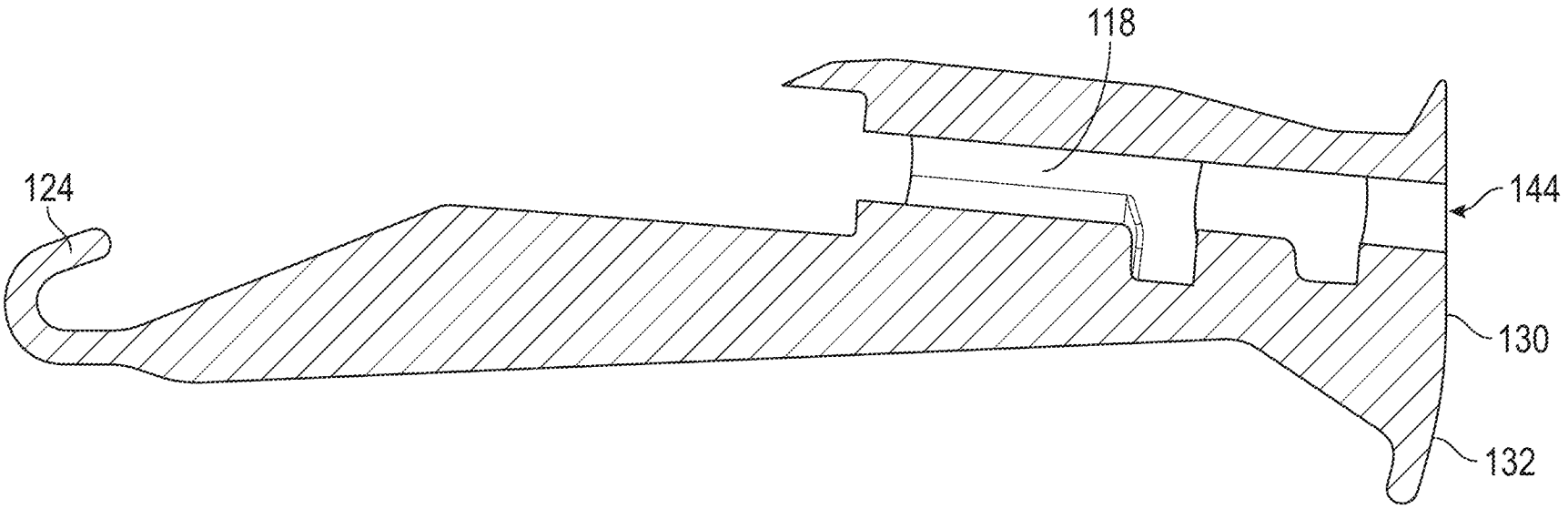
FIG. 13 is an example illustration of a cross-sectional view along the line 13-13 of FIG. 10.
Figure 14:
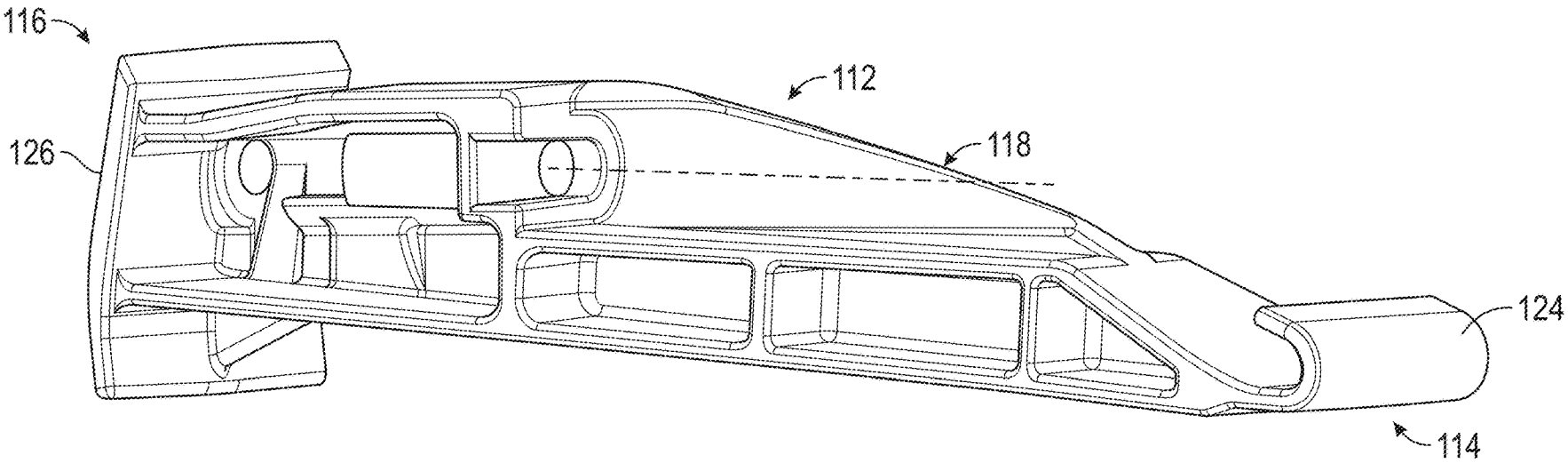
FIG. 14 is an example illustration of a first front perspective view of an embodiment of the fastening support.
Figure 15:
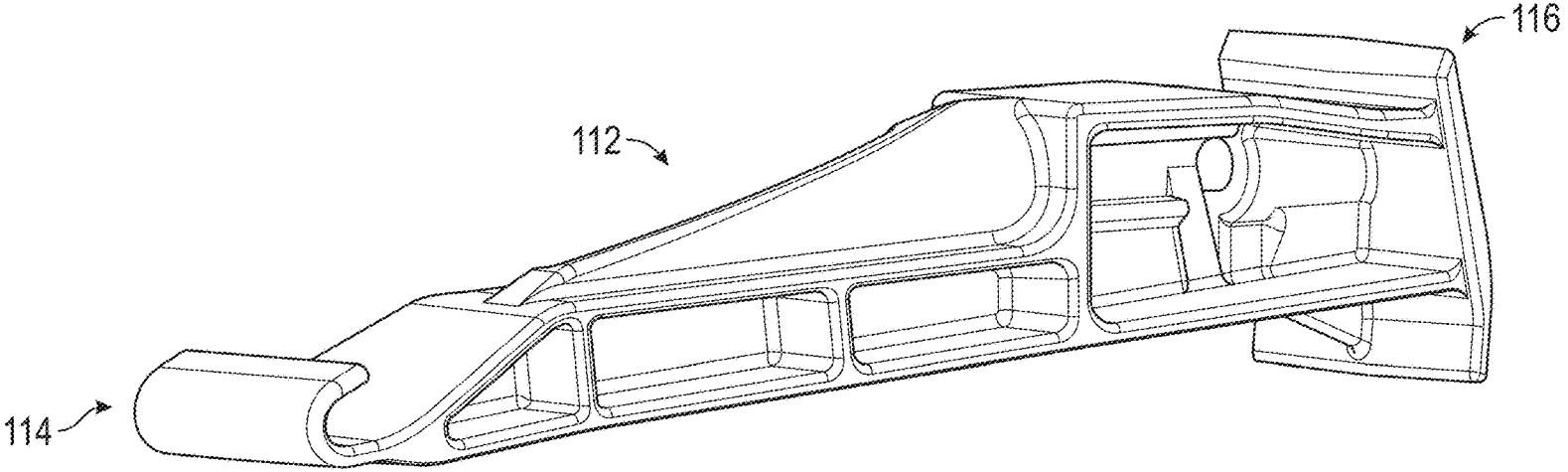
FIG. 15 is an example illustration of a second front perspective view of an embodiment of the fastening support.
Figure 16:
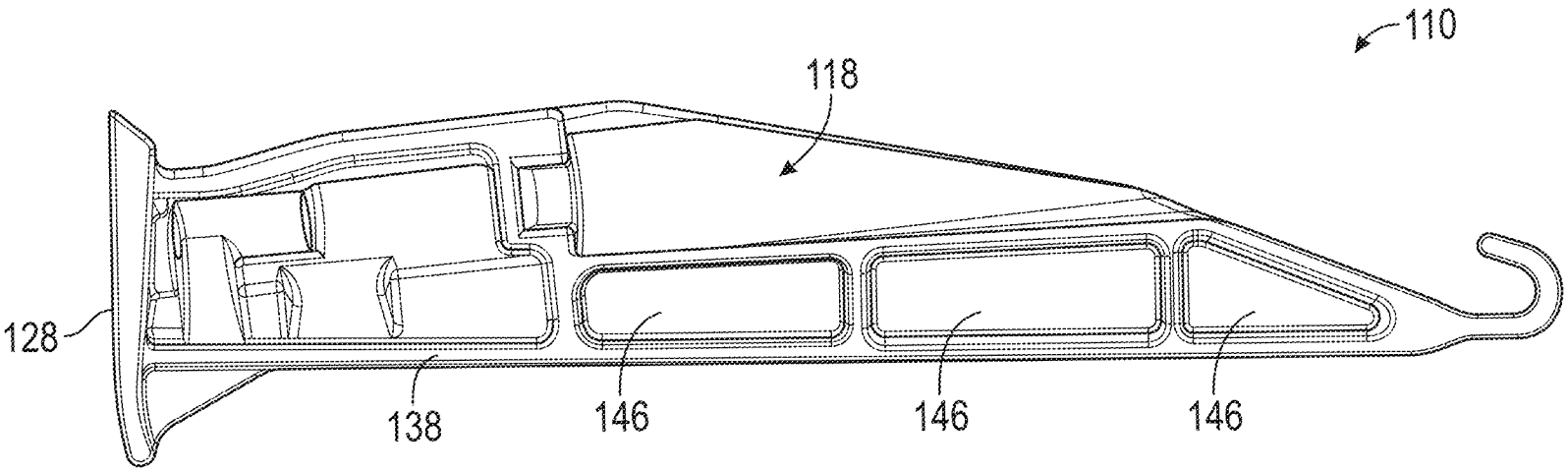
FIG. 16 is an example illustration of a first side elevation view of an embodiment of the fastening support.
Figure 17:
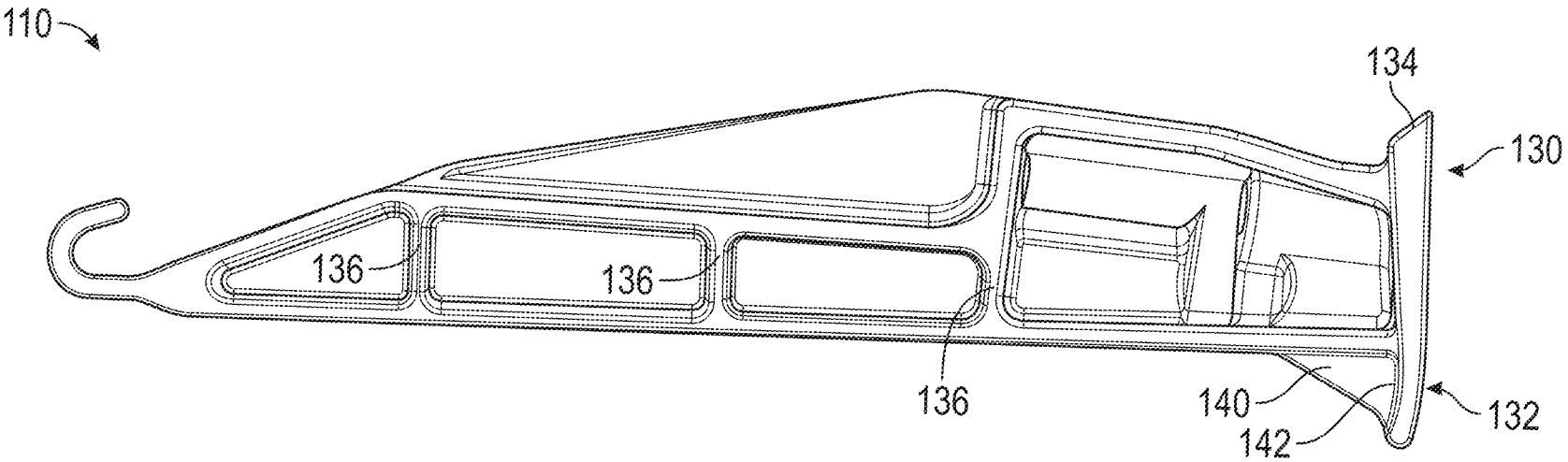
FIG. 17 is an example illustration of a second side elevation view of an embodiment of the fastening support.
Figure 18:
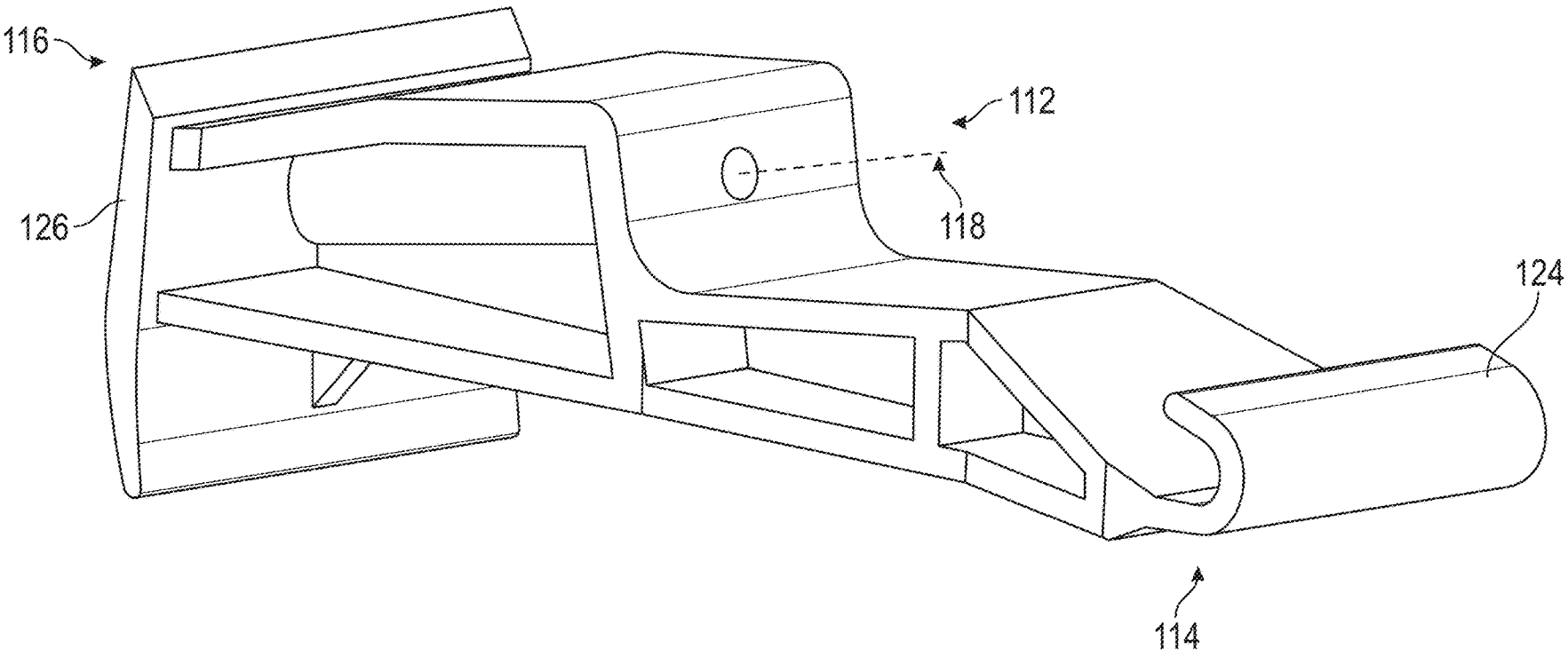
FIG. 18 is an example illustration of a front perspective view of an embodiment of the fastening support.
Figure 19:
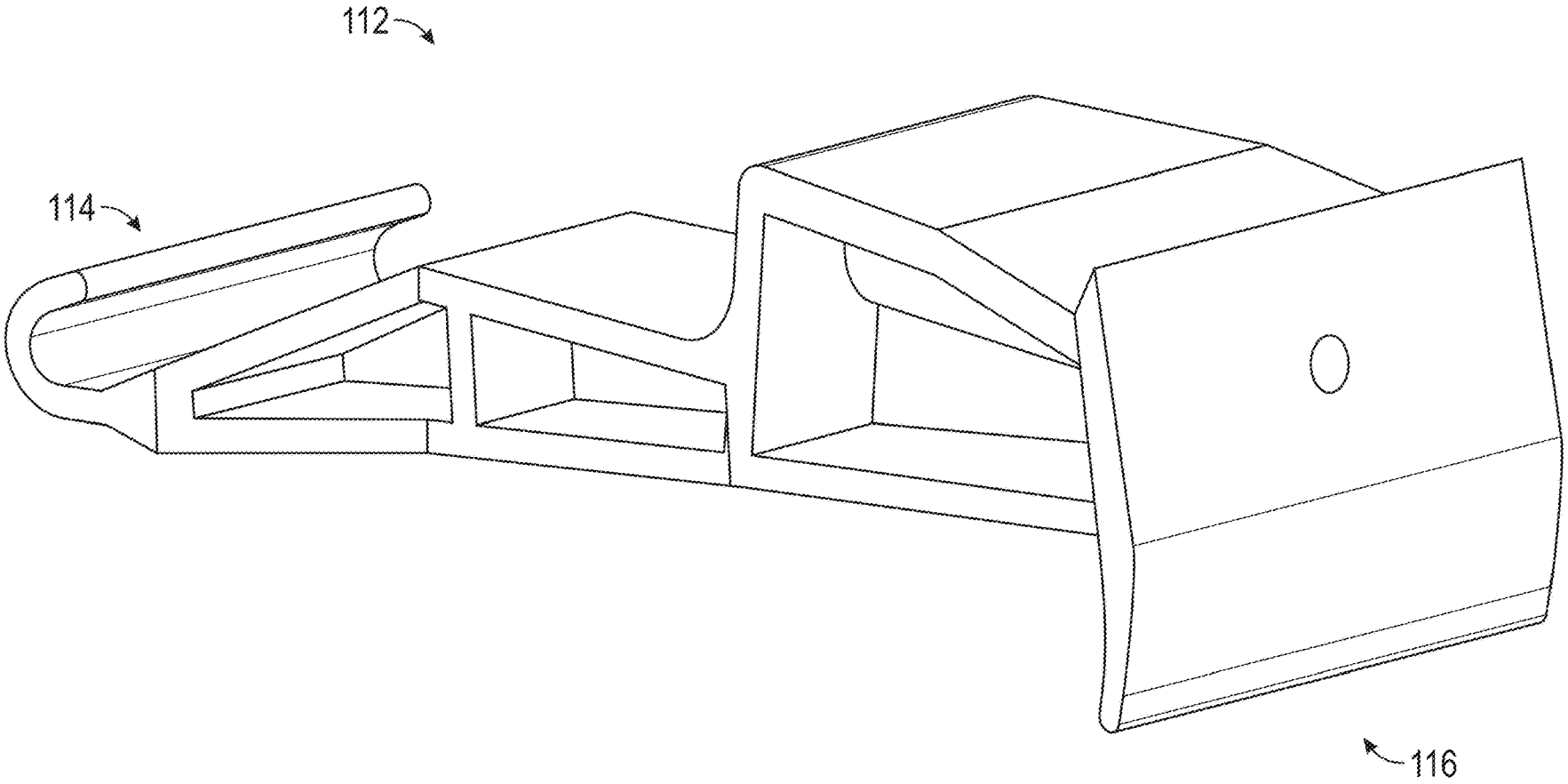
FIG. 19 is an example illustration of a rear perspective view of an embodiment of the fastening support.
Figure 20:
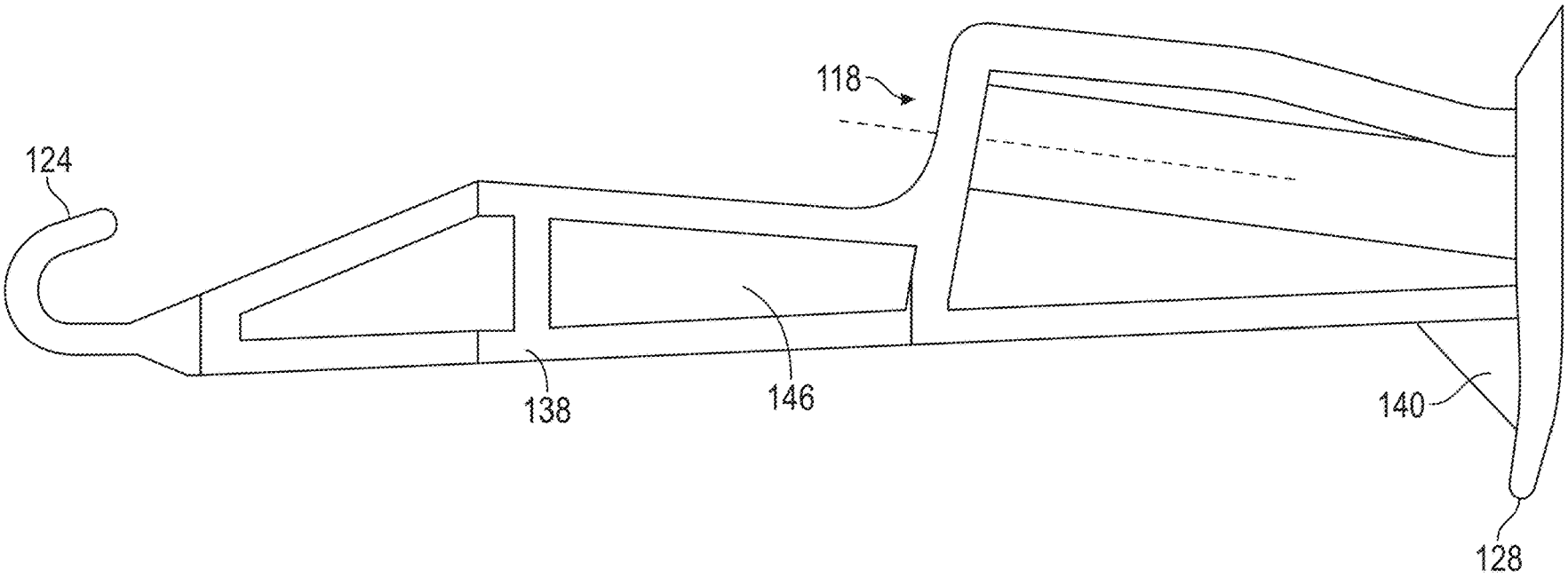
FIG. 20 is an example illustration of a side elevation view of an embodiment of the fastening support, where the opposing side view is substantially a mirror image.
Figure 21:
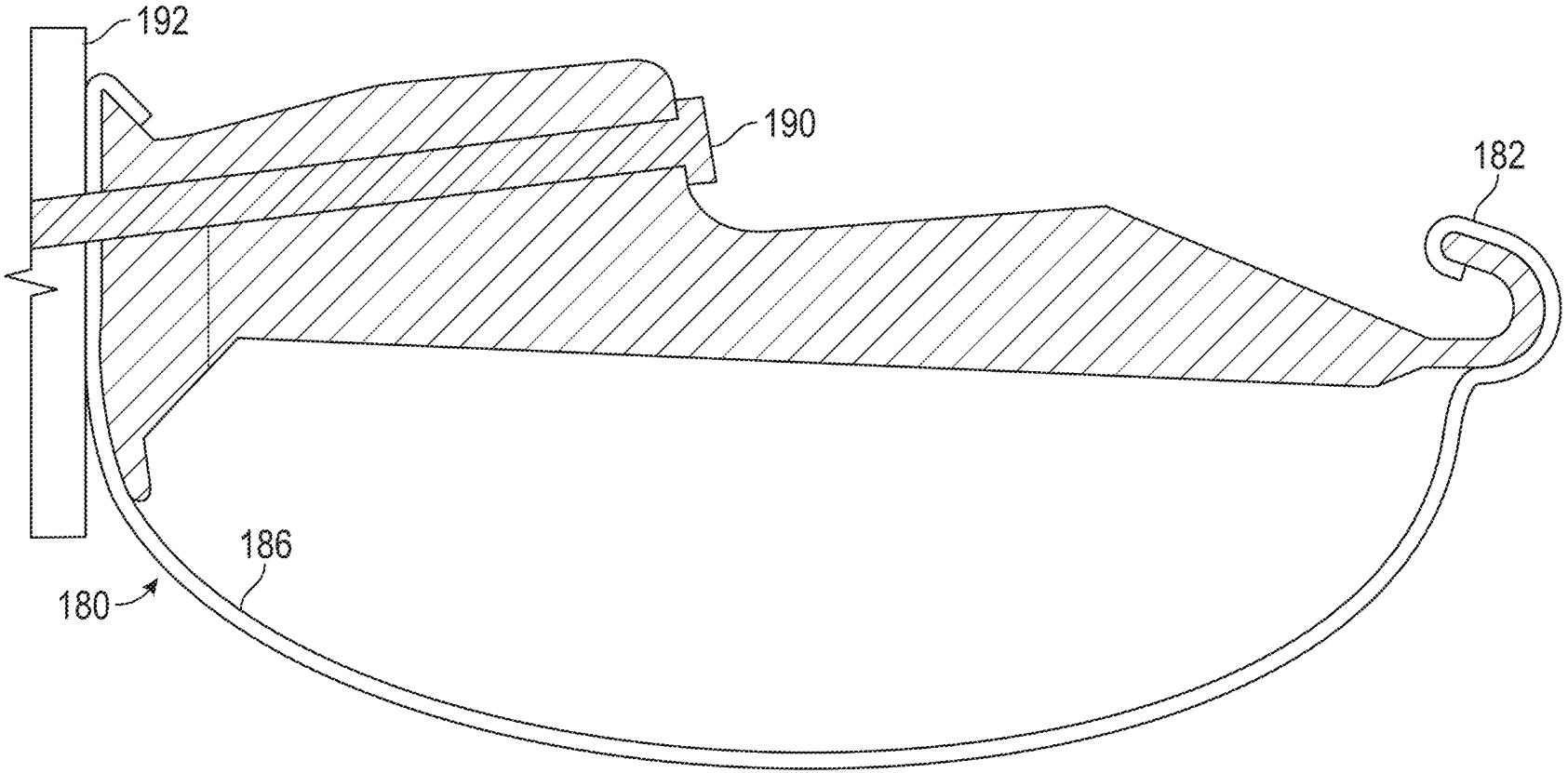
FIG. 21 is an example illustration of a cross-sectional view of an embodiment of the fastening support.

FIGS. 6-11 are example illustrations of an embodiment of fastening support device 110, shown, respectively, in first side and second side elevation, enlarged front and rear elevation, and top and bottom plan views. FIGS. 12-13 are example illustrations of cross-sectional views along the lines 12-12 and 13-13, respectively, of FIG. 10. Fastening support device 110 includes a fastener channel 118 that is structurally configured to receive fastener 190 therethrough (see, e.g., FIG. 12). Fastener channel 118 is open to rear face 128 via an aperture 144 through which fastener 190 may project for fastening device 110 and gutter 180 to structure 192. Aperture 144 is generally located below an upper edge 134 of rear gutter engagement portion 126, and may be located in upper portion 130 of rear gutter engagement portion 126. Fastener channel 118 is also accessible from front end 114, so that fastener 190 may be inserted into fastener channel 118 and driven through fastener channel 118 to fasten device 110 and gutter 180 in position. In some embodiments, a portion of fastener channel 118 may partially open, such as by being enclosed on only one side (as may be seen in FIGS. 6-8 where the first side of FIG. 6 is partially open, while the second side of FIG. 7 is closed). This feature may provide improved access to fastener channel 118, such as for purposes of inserting or driving fastener 190, as fastener channel 118 may otherwise be difficult to access when fastening support device 110 is engaged with gutter 180. In addition, or instead, fastener channel 118 may extend forwardly along support body 112. For example, fastener channel 118 of FIG. 6 is shown to extend forwardly at least as far as the forwardmost internal support 136. This configuration of fastener channel 118 provides additional strength for fastening support device 110, which is especially beneficial when the gutter is under a load.

Support body 112 may have a lower surface 138 which is substantially planar and extends between front gutter engagement portion 124 and rear gutter engagement portion 126. Lower surface 138 may be substantially planar across an entire width of support body 112. In some embodiments, lower surface 138 may be oriented substantially horizontally when fastening support device 110 is installed in a gutter and secured to a substantially vertical support. In other cases, lower surface 138 may be inclined downwardly toward the rear when device 110 so installed. Lower surface 138 is generally located below both front gutter engagement portion 124 and aperture 144 in rear face 128 of rear gutter engagement portion 126. In some cases, lower portion 132 may extend below lower surface 138.

Support body 112 may have two or more internal supports 136 projecting upwardly from lower surface 138. In the shown embodiment, internal supports 136 may span an entire width of support body 112. Some or all of internal supports 136 may project upwardly substantially to a top surface 139 of support body 112. Support body 112 may also include one or more thin walls 146 interconnecting the two or more internal supports 136 and lower surface 138. Thin walls 146 may provide structural rigidity to support body 112, while reducing the overall weight of support body 112 as compared to a comparably shaped solid body. In the embodiment of FIGS. 6-7, two internal supports 136 are shown interconnected by thin walls 146, which also interconnect with lower surface 138. In other embodiments, thin walls 146 may not be present, or may not extend fully between adjacent internal supports 136 (e.g., openings may be present in support body 112 between internal supports 136 and lower surface 138).

Fastening support device 110 may include a gusset 140 located in the angle formed between rear gutter engagement portion 126 and lower surface 138. Gusset 140 may be thin relative to the width of rear gutter engagement portion 126, and may be located substantially in the center of the width of rear gutter engagement portion 126. For example, gusset 140 may have a thickness comparable to the thickness of any of internal supports 136. In some embodiments, gusset 140 may have a rounded edge 142 (see FIG. 7), such as at the interface with rear gutter engagement portion 126. In other cases, gusset 140 may not have a rounded edge.

Rear gutter engagement portion 126 may have an upper edge 134 that is tapered inwardly toward support body 112. Said another way, upper edge 134 may be angled downwardly from the rear to the front of support body 112. This feature may facilitate insertion of fastening support device 110 into gutter 180 and/or improve engagement of rear gutter engagement portion 126 with rear edge 184.

In the shown embodiment, support body 112, front gutter engagement portion 124, and rear gutter engagement portion 126 of fastening support device 110 are unitarily formed (e.g., of single-piece construction). Fastening support device 110 may be manufactured by processes such as injection molding, 3D printing, polymer casting, or others known in the art. Example materials for the construction of fastening support device 110 include plastics suitable for high load mechanical applications, such as blends of polybutylene terephthalate (PBT), polyethylene terephthalate (PET), and/or polycarbonate; acetal homopolymer; or others as known in the art.

In some embodiments, when device 110 is completely inserted into a gutter, that is, when front gutter engagement portion 124 is engaged with inwardly bending front edge 182 and rear gutter engagement portion 126 is engaged with rear edge 184, support body 112 is entirely located internal to the half round gutter. Said another way, when fastening support device 110 is installed in gutter 180 no portion of device fastening support device 110 extends either forwardly or rearwardly beyond gutter 180. In this sense, fastening support device 110 may be considered an entirely internal support device. This feature may be particularly desirable for aesthetic purposes.

FIGS. 14-17 are example illustrations of another embodiment of fastening support device 110 showing, respectively, first and second front perspective, and first and second side elevation views. This exemplary embodiment may be particularly well suited for use with an 8 inch half round gutter; similar embodiments may be scaled for use with other sizes of gutter, such as 10 inch gutter. Features of the shown embodiment of fastening support device 110 may be the same or similar to features described elsewhere herein, for example with reference to the embodiment of FIGS. 6-11. As shown, some embodiments may include additional supporting and/or reinforcing members as may be desired for a relatively large gutter size. For example, three or more of internal supports 136 may be present, and/or three or more thin walls 146 may be present interconnecting internal supports 136 and lower surface 138.

FIGS. 18-21 are example illustrations of another embodiment of fastening support device 110 showing, respectively, front and rear perspective, side elevation, and cross-sectional views of an embodiment of the fastening support. This exemplary embodiment may be particularly well suited for use with a 6 inch half round gutter. Features of the shown embodiment of fastening support device 110 may be the same or similar to features described elsewhere herein, for example with reference to the embodiment of FIGS. 6-11. As shown, some embodiments may include a fastener channel 118 that is substantially rotational symmetrical about a central axis; e.g. the shown fastener channel 118 is not open on one side as described in other embodiments. Furthermore fastener channel 118 of this embodiment extends forwardly only as far as the rearmost internal support 136.

Figure 22:
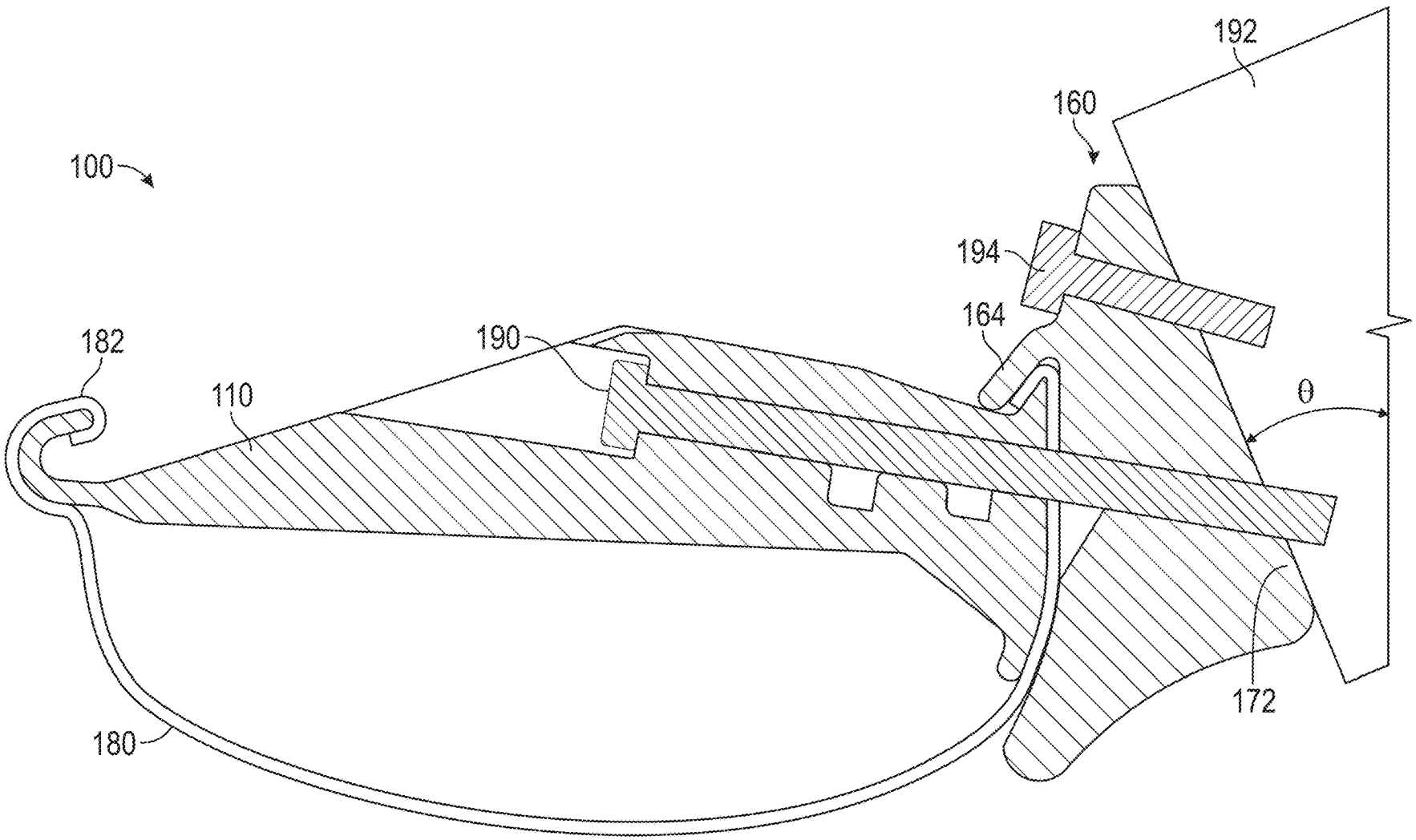
FIG. 22 is an example illustration of a cross-sectional view of an embodiment of the fastening support system.

FIG. 22 is an example illustration of a cross-sectional view of an embodiment of fastening support system 100. Fastening support system 100 may include one or more of fastening support device 110, wedge 160, fastener 190, second fastener 194, and may cooperate with, or may include, gutter 180. Features of the shown embodiment of fastening support system 100 may be similar to features described elsewhere herein, e.g. with respect to the fastening support system 100 of FIG. 1. In some cases, structure 192, where fastening support system 100 is to be mounted, may have an angled mounting face (e.g., an outward face of structure 192 may be angled away from vertical by an angle,). Wedge 160 may be configured for mounting to the angled face of structure 192, such as with second fastener 194. Wedge 160 may have a support engaging portion 162 (see also FIGS. 23-25), that is generally forward facing and shaped to engage with fastening support device 110 and/or provide a substantially vertical mounting surface adjacent gutter 180 and rear end 116 of fastening support device 110. Support engaging portion 162 may, for example, include a lip 164 that may engage with a portion of fastening support device 110 (e.g, with upper edge 134 of FIG. 7). Fastener 190 may be passed through both fastening support device 110 and wedge 160 and fastened to structure 192.

Figure 23:
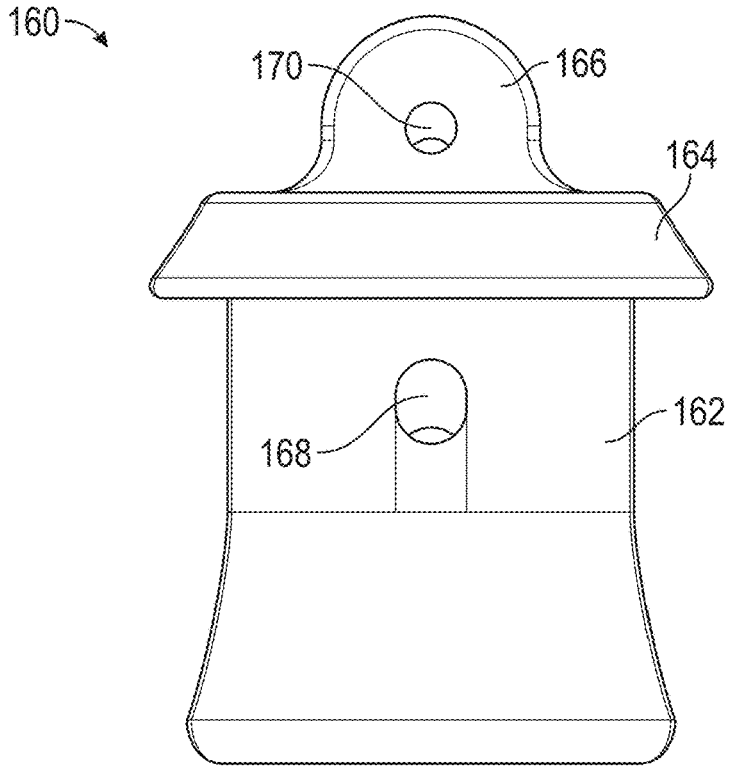
FIG. 23 is an example illustration of a front view of an embodiment of a wedge of the fastening support system.
Figure 24:
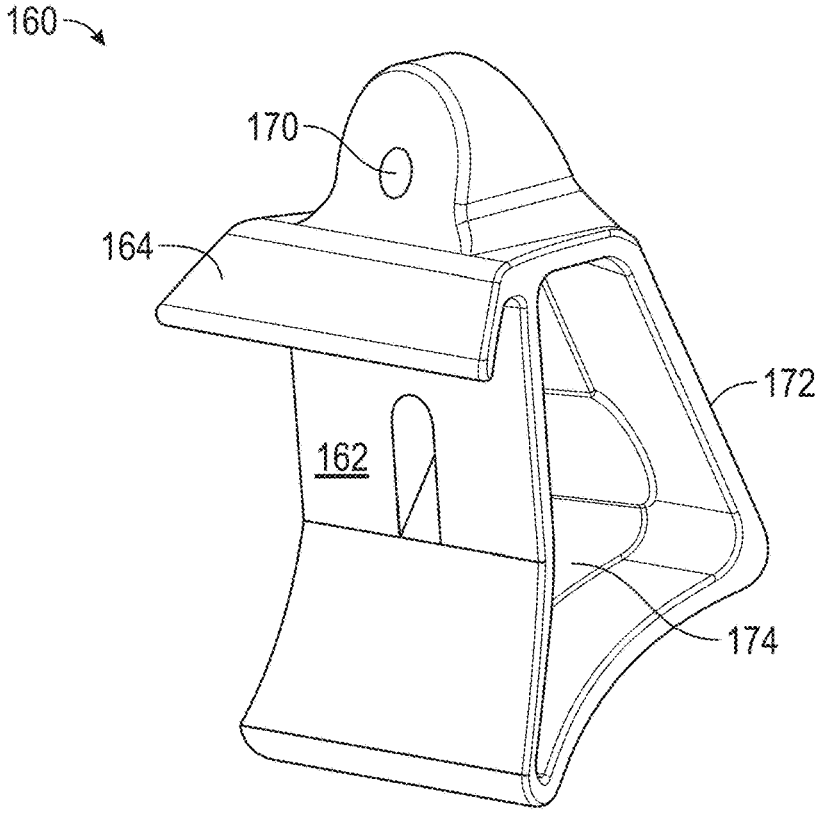
FIG. 24 is an example illustration of a perspective view of an embodiment of the wedge of the fastening support system.
Figure 25:
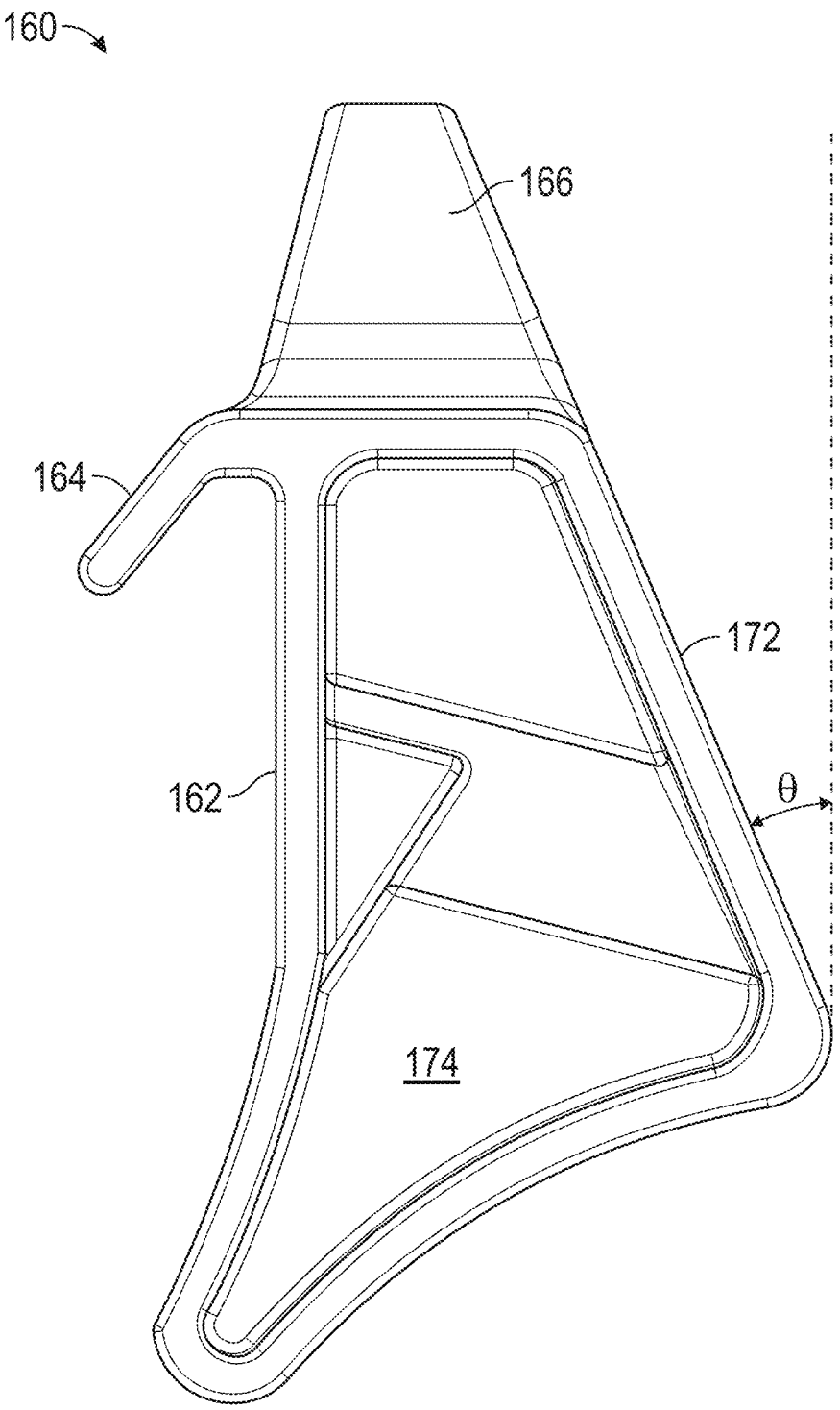
FIG. 25 is an example illustration of a side view of an embodiment of the wedge of the fastening support system.

FIGS. 23-25 are example illustrations of front, perspective, and side views, respectively, of an embodiment of wedge 160. Wedge 160 may include one or more of the following features: a support engaging portion 162, a lip 164, an upper member 166, a first through hole 168, a second through hole 170, an angled face 172, and/or a sidewall 174. Support engaging portion 162 may include one or more features as described with reference to FIG. 22. In addition, or instead, support engaging portion 162 may be shaped substantially complementary to at least a portion of a rear end of a fastening support device (e.g., rear end 116 of fastening support device 110). For example, support engaging portion 162 may be shaped with a substantially vertical upper portion corresponding to upper portion 130 of fastening support device 110. Similarly, support engaging portion 162 may be shaped with a curved lower portion shaped substantially complementary lower portion 132 of fastening support device 110. Upper member 166 may project above support engaging portion 162, and may provide a means for fastening wedge 160 to structure 192. For example, upper member 166 as shown includes a second through hole 170, through which second fastener 194 may be passed to attach wedge 160 to structure 192 (see FIG. 22). Wedge 160 may also include a first through hole 168, configured to align with fastener channel 118 of fastening support device 110 when fastening support device 110 is engaged with wedge 160. In this manner, fastener 190 may be passed through the fastener channel 118 and first through hole 168 and fastened to structure 192.

Wedge 160 may include an angled face 172 that is rearwardly oriented when the system is installed. The angle, θ, of angled face 172 (with respect to vertical) may generally be selected to correspond to an angle of structure 192 where the system is to be installed. In embodiments, angled face 172 may have an angle of about 7.5, 15, 22.5, 30, 37.5, or 45 degrees offset from vertical, although other angles may be used. In some cases, wedge 160 may not have an angled face (e.g., the rear face of wedge 160 may be substantially vertical).

Wedge 160 may be manufactured by processes such as injection molding, 3D printing, polymer casting, or others known in the art. Wedge 160 may be constructed of similar materials as the fastening support device.

Figure 2:
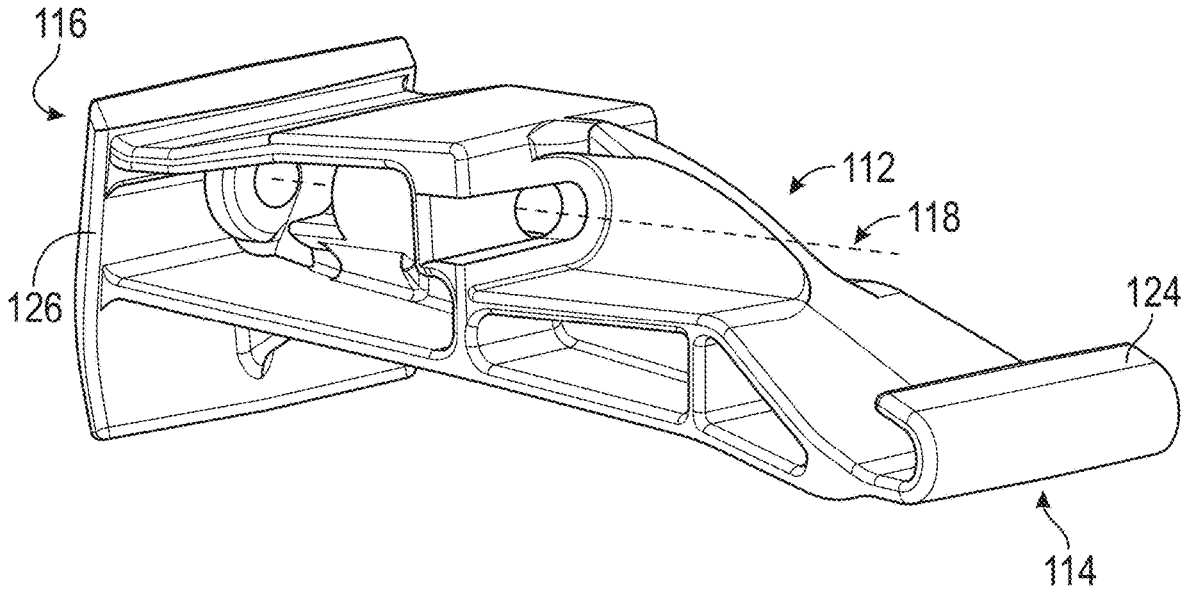
FIG. 2 is an example illustration of a first front perspective view of an embodiment of a fastening support.
Figure 3:
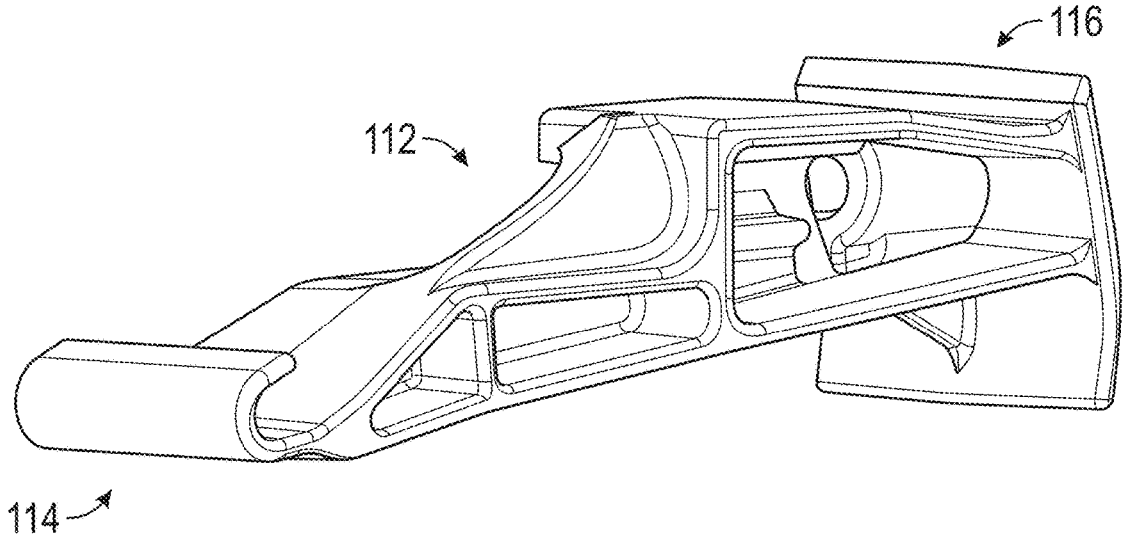
FIG. 3 is an example illustration of a second front perspective view of an embodiment of the fastening support.
Figure 4:
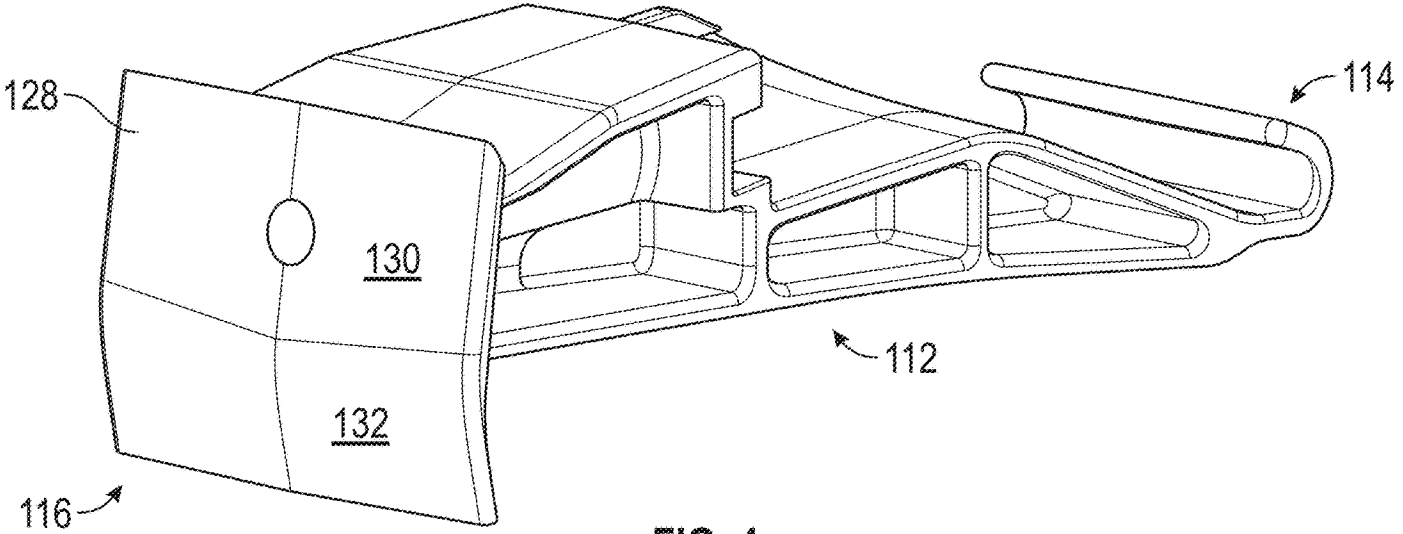
FIG. 4 is an example illustration of a first rear perspective view of an embodiment of the fastening support.
Figure 5:
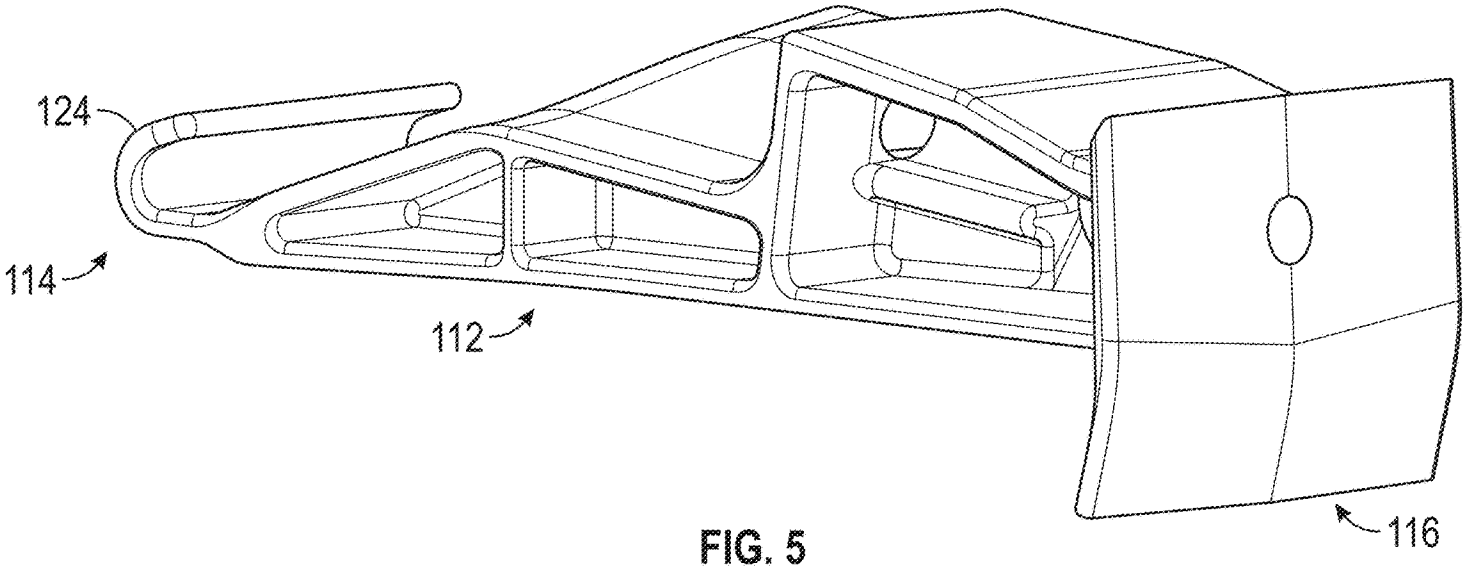
FIG. 5 is an example illustration of a second rear perspective view of an embodiment of the fastening support.

In some embodiments, fastening support device 110 cooperates with a fastener 190 to form a fastening support system 100 (refer, e.g., to FIGS. 1-2). One or more of fastener 190 (such as a screw, or similar) may be packaged with one or more of fastening support device 110 to form a fastening support system 100 suitable for supporting one or more sections of gutter. In some cases, fastener 190 may be retained within fastener channel 118 (e.g., in a case where fastener 190 is a captive screw).

Further provided is a gutter system including (refer, e.g., to FIG. 1 and FIG. 12) a gutter 180 (e.g., one or more sections of half round gutter), one or more of fastening support device 110, and one or more of fastener 190:

The embodiments of the fastening support for half round gutters and methods of use described herein are exemplary and numerous modifications, combinations, variations, and rearrangements can be readily envisioned to achieve an equivalent result, all of which are intended to be embraced within the scope of the appended claims. Further, nothing in the above-provided discussions of the devices, systems, and methods should be construed as limiting the invention to a particular embodiment or combination of embodiments. The scope of the invention is defined by the appended claims.

I claim:

1. A fastening support device structurally configured to cooperate and engage with a half round gutter having an inwardly bending front edge, a rear edge, and an internal gutter wall, the device further cooperating with a fastener, the device comprising:

a support body having a front end and a rear end opposing the front end;

a front gutter engagement portion disposed at the front end and structurally configured for engagement with the inwardly bending front edge of the half round gutter;

a rear gutter engagement portion disposed at the rear end and structurally configured for engagement with the rear edge of the half round gutter, the rear gutter engagement portion having a rear face configured to contact the internal gutter wall, the rear face having a substantially vertical upper portion adjacent a curved lower portion, the curved lower portion having a curvature shaped to substantially conform to the internal gutter wall;

a fastener channel structurally configured to receive the fastener therethrough, the fastener channel open to the rear face and accessible from the front end when the front gutter engagement portion is engaged with the inwardly bending front edge;

wherein the rear gutter engagement portion has an inwardly tapered upper edge; and wherein the support body, the front gutter engagement portion, and the rear gutter engagement portion are unitarily formed.

2. The device of claim 1, wherein the front gutter engagement portion is shaped substantially complementary to the inwardly bending front edge of the half round gutter.

3. The device of claim 1, wherein the support body includes a substantially planar lower surface extending between the front gutter engagement portion and the rear gutter engagement portion.

4. The device of claim 3, wherein the support body includes two or more internal supports projecting upwardly from the lower surface.

5. The device of claim 4, wherein the two or more internal supports span an entire width of the support body.

6. The device of claim 4, wherein the two or more internal supports and the lower surface are connected by one or more thin walls.

7. The device of claim 4, wherein the fastener channel extends forwardly along the support body up to a forwardmost internal support of the two or more internal supports.

8. The device of claim 3, wherein the curved lower portion of the rear face extends below the lower surface.

9. The device of claim 3, furthering including a gusset located in an angle formed between the rear gutter engagement portion and the lower surface.

10. The device of claim 9, wherein the gusset includes a rounded edge.

11. The device of claim 1, wherein at least a portion of the fastener channel is open on a side.

12. The device of claim 1, wherein, when the front gutter engagement portion is engaged with the inwardly bending front edge and the rear gutter engagement portion is engaged with the rear edge of the half round gutter, the support body is entirely located internal to the half round gutter.

13. A fastening support system structurally configured to cooperate and engage with a half round gutter having an inwardly bending front edge, a rear edge, and an internal gutter wall, the system comprising:

a fastener; and a fastening support device including:

a support body having a front end and a rear end opposing the front end;

a front gutter engagement portion disposed at the front end and structurally configured for engagement with the inwardly bending front edge of the half round gutter;

a rear gutter engagement portion disposed at the rear end and structurally configured for engagement with the rear edge of the half round gutter, the rear gutter engagement portion having a rear face configured to contact the internal gutter wall, the rear face having a substantially vertical upper portion adjacent a curved lower portion, the curved lower portion having a curvature shaped to substantially conform to the internal gutter wall;

wherein the support body includes a substantially planar lower surface extending between the front gutter engagement portion and the rear gutter engagement portion, and two or more internal supports projecting upwardly from the lower surface;

a fastener channel structurally configured to receive the fastener therethrough, the fastener channel open to the rear face and accessible from the front end when the front gutter engagement portion is engaged with the inwardly bending front edge; and wherein the support body, the front gutter engagement portion, and the rear gutter engagement portion are unitarily formed; and a wedge having a support engaging portion shaped to engage with the rear end of the fastening support device and a through hole structurally configured to receive the fastener therethrough.

14. The system of claim 13, wherein the fastener is retained within the fastener channel.

15. A gutter system comprising:

a half round gutter having an inwardly bending front edge, a rear edge, and an internal gutter wall;

a fastener; and a fastening support device structurally configured to engage with the half round gutter, the device including:

a support body having a front end and a rear end opposing the front end;

a front gutter engagement portion disposed at the front end and structurally configured for engagement with the inwardly bending front edge of the half round gutter;

a rear gutter engagement portion disposed at the rear end and structurally configured for engagement with the rear edge of the half round gutter, the rear gutter engagement portion having a rear face configured to contact the internal gutter wall, the rear face having a substantially vertical upper portion adjacent a curved lower portion;

wherein the support body includes a substantially planar lower surface extending between the front gutter engagement portion and the rear gutter engagement portion, and two or more internal supports projecting upwardly from the lower surface;

a fastener channel structurally configured to receive the fastener therethrough, the fastener channel open to the rear face and accessible from the front end when the front gutter engagement portion is engaged with the inwardly bending front edge;

wherein the support body, the front gutter engagement portion, and the rear gutter engagement portion are unitarily formed; and a wedge having a support engaging portion shaped to engage with the rear end of the fastening support device and a through hole structurally configured to receive the fastener therethrough.

* * * * *